US011959361B2

(12) United States Patent
Karlsson et al.

(10) Patent No.: US 11,959,361 B2
(45) Date of Patent: Apr. 16, 2024

(54) PNEUMATIC DRILL HAMMER COMPRISING A BOOST CHAMBER AND A DRILLING RIG COMPRISING SUCH A DRILL HAMMER

(71) Applicant: EPIROC DRILLING TOOLS AKTIEBOLAG, Fagersta (SE)

(72) Inventors: Per-Anders Karlsson, Nybro (SE); Thomas Lilja, Kalmar (SE); Ernst Arne Johan Bram, Kalmar (SE); Magnus Gustavsson, Kalmar (SE)

(73) Assignee: EPIROC DRILLING TOOLS AKTIEBOLAG, Fagersta (SE)

( * ) Notice: Subject to any disclaimer, the term of this patent is extended or adjusted under 35 U.S.C. 154(b) by 77 days.

(21) Appl. No.: 17/771,060

(22) PCT Filed: Oct. 23, 2020

(86) PCT No.: PCT/SE2020/051028
§ 371 (c)(1),
(2) Date: Apr. 22, 2022

(87) PCT Pub. No.: WO2021/086251
PCT Pub. Date: May 6, 2021

(65) Prior Publication Data

US 2022/0389761 A1 Dec. 8, 2022

(30) Foreign Application Priority Data

Oct. 31, 2019 (SE) ..... 1951244-1

(51) Int. Cl.
*E21B 4/14* (2006.01)
*E21B 7/02* (2006.01)
*E21B 10/36* (2006.01)

(52) U.S. Cl.
CPC ..... *E21B 4/14* (2013.01); *E21B 7/022* (2013.01); *E21B 10/36* (2013.01)

(58) Field of Classification Search
CPC . E21B 4/14; E21B 7/022; E21B 10/36; B25D 17/245; B25D 9/08; B25D 9/14; B25D 2217/0023
See application file for complete search history.

(56) References Cited

U.S. PATENT DOCUMENTS 5,322,136 A * 6/1994 Bui ..... E21B 4/14 173/110
9,103,164 B2 * 8/2015 In ..... B25D 9/00
(Continued)

FOREIGN PATENT DOCUMENTS

CN 104265154 A 1/2015
EP 0549549 A1 6/1993
(Continued)

OTHER PUBLICATIONS

International Search Report and Written Opinion dated Jan. 29, 2021 for International Application No. PCT/SE2020/051028, 9 pages.

*Primary Examiner* — Yong-Suk (Philip) Ro
(74) *Attorney, Agent, or Firm* — Sage Patent Group

(57) ABSTRACT

The invention relates to a pneumatically operated drill hammer, comprising a piston and a distributor axially arranged relative to each other in a housing, the piston being arranged to be moved axially between a first position and a second position. The drill hammer further includes a pneumatic drive system, including a drive chamber, a return chamber and a plurality of channels for distribution of drive gas in said drive system. The return chamber is arranged at a lower side of the piston and the drive chamber is arranged at an upper side of the piston, wherein the drive chamber is defined by a variable space enclosed by at least the housing,
(Continued)

the piston and the distributor. The drive chamber includes at least one inlet port and at least one exhaust port arranged at a circumference of the drive chamber.

12 Claims, 5 Drawing Sheets

(56) References Cited

U.S. PATENT DOCUMENTS

| | | | | |
|---|---|---|---|---|
| 2016/0153237 | A1* | 6/2016 | Lorger | E21B 1/00 175/296 |
| 2020/0270949 | A1* | 8/2020 | Välisalo | E21B 4/14 |

FOREIGN PATENT DOCUMENTS

| | | | |
|---|---|---|---|
| EP | 1963609 | A1 | 9/2008 |
| WO | 2007/073275 | A1 | 6/2007 |
| WO | 2008/060216 | A1 | 5/2008 |
| WO | 2010/082871 | A1 | 7/2010 |
| WO | 2012/049331 | A2 | 4/2012 |
| WO | 2013/050657 | A1 | 4/2013 |
| WO | 2014/084772 | A1 | 6/2014 |
| WO | 2018/220098 | A1 | 12/2018 |
| WO | 2018/224732 | A1 | 12/2018 |

* cited by examiner

PNEUMATIC DRILL HAMMER COMPRISING A BOOST CHAMBER AND A DRILLING RIG COMPRISING SUCH A DRILL HAMMER

CROSS-REFERENCE TO RELATED APPLICATIONS

This application is a 35 U.S.C § 371 national stage application for International Application No. PCT/SE2020/051028, entitled "PNEUMATIC DRILL HAMMER COMPRISING A BOOST CHAMBER AND A DRILLING RIG COMPRISING SUCH A DRILL HAMMER", filed on Oct. 23, 2020, which claims priority to Swedish Patent Application No. 1951244-1, filed on Oct. 31, 2019, the disclosures and contents of which are hereby incorporated by reference in their entireties.

TECHNICAL FIELD

The present invention relates to a pneumatic drill hammer comprising a boost chamber, a DTH-drill hammer comprising such a boost chamber, and a drilling rig comprising such a drill hammer.

BACKGROUND ART

Pneumatic drill hammers are rather complex devices due to the repeated process of transferring force to a material by means of their high frequency and energy intensive motion. They need to transfer a large quantity of kinetic energy to a drill bit attached thereto in each stroke, but at the same time they need to not hit the internal machinery therein with an equally high impact, but rather have a smoother stopping and reversing of the movement when it comes to the piston of the drill hammer moving back within the device itself. Yet such a piston must for each new stroke accelerate fast, to once again be able to provide the next stroke to the drill bit hard and fast, over and over again.

To achieve such a mechanic, complex solutions utilizing valves that open and close by means of specific internal pressures may be used, as an example. Such valves may thus be used to re-direct the internal pressure between different channels and/or cavities that push the piston of the drill hammer in the intended direction for each position of its stroke.

Such a solution may be an efficient way of using the already applied pressure from the pneumatic drive gas of the device, yet the drill hammer will be bulkier due to added mechanics and additional gas channels and/or cavities that may be needed, and also be more expensive to manufacture and thus sell.

It is thus an intricate problem to solve, and/or a technical area where there still is improvements to be made.

SUMMARY OF THE INVENTION

Despite prior art there is a need to develop a pneumatically operated drill hammer that exhibits increased efficiency while having a sleek and compact design. There is also a need to develop such a pneumatically operated drill hammer, which is suitable for modularization of different types of drill hammers and drilling arrangements. There is even further a need to develop such a pneumatically operated drill hammer, which is less prone to mechanical failure of critical components thereof. There is furthermore a need to develop a Down-The-Hole, or DTH,-drill hammer having such characteristics, and to develop a drilling rig comprising such a drill hammer.

An object of the invention is thus to provide a pneumatically operated drill hammer that exhibits increased efficiency while having a sleek and compact design. Another object is to provide such a pneumatically operated drill hammer, which is suitable for modularization of different types of drill hammers and drilling arrangements. A further object is to provide such a pneumatically operated drill hammer, which is less prone to mechanical failure of critical components thereof. An even further object is to provide a Down-The-Hole, or DTH, drill hammer having such characteristics, and to develop a drilling rig comprising such a drill hammer.

According to a first aspect, a pneumatically operated drill hammer is provided. The pneumatically operated drill hammer comprises a piston and a distributor, axially arranged relative each other in a housing, wherein the piston is arranged to be moved axially between a first position and a second position. The drill hammer further comprises a pneumatic drive system, which comprises a drive chamber, a return chamber and a plurality of channels for distribution of drive gas in said drive system. The return chamber is arranged at a lower side of the piston and the drive chamber is arranged at an upper side of the piston, between the piston and the distributor. The drive chamber is defined by a variable space, enclosed by at least the housing, the piston and the distributor. The drive chamber comprises at least one inlet port and at least one exhaust port, arranged at a circumference of the drive chamber. Pressurization of the pneumatic drive system alternates pressurization of the drive chamber and the return chamber, wherein the piston moves back and forth between the first and second position by means of said alternating pressurization of the drive chamber and return chamber. The piston further comprises a first inner surface, and the distributor comprises a second inner surface, said first and second inner surfaces being arranged to align adjacent with each other when the piston moves towards the first position. Such alignment divides the drive chamber into a sub-drive chamber and at least one boost chamber, wherein said at least one boost chamber is separated from the inlet and the exhaust ports.

This has the advantage that the boost chamber is formed when the piston is moved towards the first position, which correlates to an upper position with regards to downwards directed drilling operation. When the boost chamber is formed and defined in such a manner, and combined with the fact that it is separated from the ports of the drive chamber, said boost chamber will be closed off from the pneumatic drive system, wherein a continued upwards movement of the piston towards the first position will automatically be dampened by means of the increased build-up of pressure within the confined boost chamber. This provides a plurality of beneficial features to the drill hammer. As the drill hammer performs its main function by means of downwards directed strokes of the piston, which hits a drill bit that impact the surface that is being drilled, such strokes are thus both dampened on their way upwards, and then given an initial boost downwards, both by means of the pressure that is built up in the confined boost chamber. This advantage is also gained in a purely passive manner by means of the boost chamber being formed by the geometries of the parts forming and defining it, wherein the effects are gained without the need to add additional complex machinery and/or devices. Additionally, when the pressure is built up within the boost chamber, the piston is pretty much guaranteed to not being able to fully reach and hit/impact the distributor, and thus mechanical contact between the two is avoided, mechanical contact that in worst case scenario could lead to degradation and mechanical failure of said components. The boost chamber thus provides an increased efficiency in a purely passive manner, while at the same time lowering the risk of harming the components of the drill hammer.

In some examples, the sub-drive chamber and the boost chamber when formed may comprise inner axially lengths separate in size at any given moment.

This has the advantage that it is guaranteed that the chamber having the shortest inner axial length will be fully depleted if the pressure within the system would leak and dissipate for some reason. Thus, it is by means of design possible to control which parts of the piston and the distributor that would impact with each other if such an occurrence would happen. This may hence be utilized to protect the portions of said elements if any of them would be more delicate with respect to mechanical impact, and/or would reach mechanical failure the fastest due to such an impact.

In some examples, the inner axial length of the boost chamber may be longer than the inner axial length of the sub-drive chamber.

This has the advantage that the portions of the piston and the distributor that define the boost chamber would be protected more from mechanical impact, as they would not reach each other even if the pressure would be lost completely within the drive chamber.

In some examples, the inner axial length of the boost chamber may be shorter than the inner axial length of the sub-drive chamber.

This has the advantage that the portions of the piston and the distributor that define the sub-drive chamber would be protected more from mechanical impact, as they would not reach each other even if the pressure would be lost completely within the drive chamber.

In some examples, the sub-drive chamber and the boost chamber when formed comprises inner axially lengths equal in size at any given moment.

This has the advantage that a mechanical impact between the piston and the distributor would be spread out over an as large surface as possible, as the portions of the piston and the distributor that define the sub-drive chamber and the portions of the piston and the distributor that define the boost chamber would get into contact simultaneously if the pressure would be lost completely within the drive chamber.

In some examples, the distributor may comprise a projection and the piston may comprise a recess, wherein the first inner surface of the piston is a surface of said recess and the second inner surface is a surface of said projection.

This has the advantage that the boost chamber may be formed by simple geometric design choices of the piston and the distributor, wherein the boost chamber may be introduced to the drill hammer in a very simple yet effective and reliable manner.

In some examples, the projection and the recess may be rotationally symmetrical about a longitudinal centre axis of the drill hammer.

This has the advantage that the piston, will be very robust and less prone to mechanical degradation when being using large drive pressures, as there are fewer mechanically weaker portions on such a piston, which weaker portions would risk accumulating forces acting thereto. Furthermore, a rotationally symmetrical piston is faster and easier to manufacture as it may be made by turning of a piece of metal solely.

In some examples, a sidewall of the boost chamber may comprise a hole in which an adjustable element may be arranged to be selectively movable to adjust a volume of said hole, wherein positioning of the adjustable element in the hole may regulate an internal volume of the boost chamber.

This has the advantage that the effects of the boost chamber may be tuned with high accuracy with regards to its internal volume, which in turn affects the pressure and the forces thereof. By means of providing such an adjustment device to the boost chamber, a larger variation of effects may be provided to the drill hammer without the need to modify and/or replace any one of the piston or the distributor to change the internal volume of a specific boost chamber.

In some examples, the piston may comprise a third inner surface, and the distributor may comprise a fourth inner surface, said third and fourth inner surfaces being arranged to align adjacent each other when the piston moves towards the first position, wherein said alignment divides the drive chamber further and forms a second boost chamber, said second boost chamber being separated from the first boost chamber and the inlet and exhaust ports.

This has the advantage that the effects of the boost chamber to the drive chamber may be further enhanced and modified by means of introducing the second boost chamber. The pressure within the drive chamber and its sub-chambers when formed may thus provide the design option of altering the pressure build-ups and thus the motion of the piston in a plurality of steps, so as to provide a custom made stroke to the piston of such a drill hammer.

In some examples, the at least one of the inner surfaces may comprise a bevelled edge, arranged at a side of said inner surface that is aligned with another inner surface to form a boost chamber when the piston moves towards the first position.

This has the advantage that the pressure build-up within said boost chamber may be smoothened out, as said boost chamber will be formed in a less immediate manner due to parts of the pressurized gas may be pushed out of the space that is to form said boost chamber until it is fully formed.

In some examples, the drill hammer may be a Down-The-Hole, DTH, -hammer.

This has the advantage that a Down-The-Hole, DTH, -hammer may be provided with all the advantageous features of the drill hammer according to the disclosure.

According to a second aspect, a drilling rig is provided, said drilling rig comprising a drill line, comprising at least one drill pipe, a source of drive gas and at least one pump for control said drive gas, wherein the drill line comprises a drill hammer according to the first aspect.

This has the advantage that a drilling rig may be provided with all the advantageous features of the drill hammer according to the first aspect.

BRIEF DESCRIPTION OF THE DRAWINGS

Below is a description of, as examples, embodiments with reference to the enclosed drawings, in which.

DETAILED DESCRIPTION

Figure 1A:
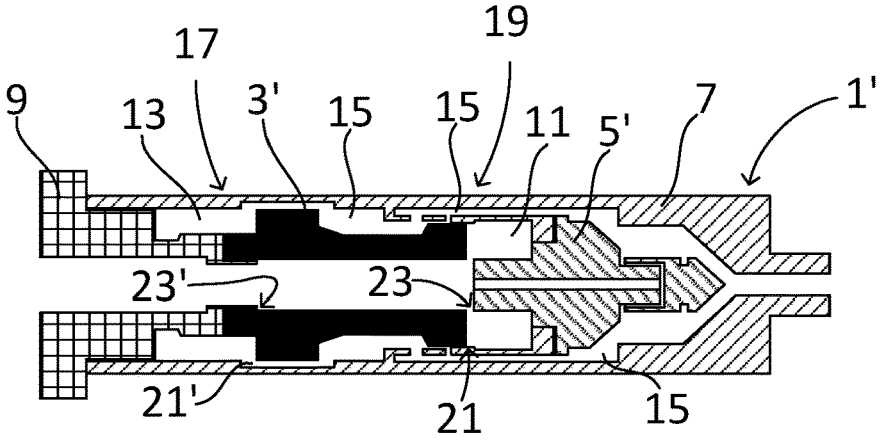
FIGS. 1*a*-1*e* show schematic cross-sectional side views of a drill hammer in various stages of its stroke, according to prior art.

The description of the various features, and modifications thereof, according to the disclosure will herein be described in more detail with reference to the accompanied drawings. It is thus to be understood that embodiments comprising any of the described feature or a combination of features may be assembled in accordance with the description herein.

FIGS. 1*a*-1*e* show schematic cross-sectional side views of a drill hammer 1 in various stages of its stroke, according to prior art. Herein the basic interaction of the parts of a drill hammer 1 will be explained briefly to alleviate potential issues with understanding the technical area and how the invention comes into play therein. The drill depicted in FIGS. 1*a*-1*e* may be perceived as somewhat simplified schematic representation of prior art, yet representative to explain the technology. The same features referenced to for FIGS. 1*a*-1*e* will be referenced with regards to the embodiments of the invention where so is possible.

The drill hammer 1' depicted in FIGS. 1*a*-1*e* is a pneumatically operated drill hammer, wherein it should be obvious that it is operated with a pressurized gas, provided from a source of such pressurized gas, wherein said source may positioned externally with regards to the drill hammer 1' itself. The drill hammer 1' comprises a piston 3' and a distributor 5' axially arranged relative each other in a housing 7. The piston 3' is arranged to be moved axially between a first position and a second position, wherein the movement between said two positions corresponds to a stroke of the piston 3', which stroke hits a drill bit 9 of the drill hammer 1' to perform a drilling action. The drill hammer 1' further comprises a pneumatic drive system, which is configured for receiving a pressurized gas from the mentioned source of said gas. The pneumatic drive system comprises a drive chamber 11, a return chamber 13 and a plurality of channels 15 for distribution of drive gas in said drive system. The return chamber 13 is arranged at a lower side 17 of the piston 3' and the drive chamber 11 is arranged at an upper side 19 of the piston 3, between the piston 3 and the distributor 5'. The term lower herein refers to a left portion of the figures, which is the portion that is downwards oriented if the drill bit 9 is arranged to drill vertically down into a surface. The drive chamber 11 is defined by a variable space enclosed by at least the housing 7, the piston 3' and the distributor 5'. The drive chamber 11 comprises at least one inlet port 21 and at least one exhaust port 23 arranged at a circumference of the drive chamber 11. The return chamber 13 correspondingly comprises similar inlet and exhaust ports 21',23', wherein both drive and return chambers 11, 13 may be pressurized and de-pressurized by means of said ports 21, 23, 21', 23'. Pressurization of the pneumatic drive system is thus configured to alternate pressurization of the drive chamber 11 and the return chamber 13, wherein the piston 3' moves back and forth between the first and second position by means of said alternating pressurization of the drive chamber 11 and the return chamber 13.

It should herein be mentioned that the phrasing downwards is not to be viewed in a restrictive manner. The drill hammers described throughout the disclosure are to be perceived as being usable in any angle of extension, wherein a downwards direction is merely used as a reference orientation for the sake of simplicity. Any wording or phrasing dependent on directional terms such as up and/or down are thus to be understood as being relative such an exemplary downwards orientation of the drill hammer.

FIG. 1*a* shows the piston 3' in abutment with the drill bit 9, which is at least in the vicinity of the second position of the piston 3' (it should be mentioned that the first position is to be perceived as the highest position the piston may be in during operation, and the lower position is the corresponding lowest position thereof, when the drill hammer is assumed to be oriented vertically downwards). In this positioning of the piston 3' it is seen that the pneumatic drive system provides the return chamber 13 with pressurized gas, by means of the positioning of the piston 3' relative the housing 7, which opens the inlet port 21' of the return chamber 13. Simultaneously the exhaust port 23 of the drive chamber 11 is herein seen in an open state, wherein the return chamber 13 is pressurized and the drive chamber 11 is not. The resulting force of this state of pressurization will thus lead to the piston 3' to be biased to move towards its first position and thus towards the distributor 5'.

Figure 1B:
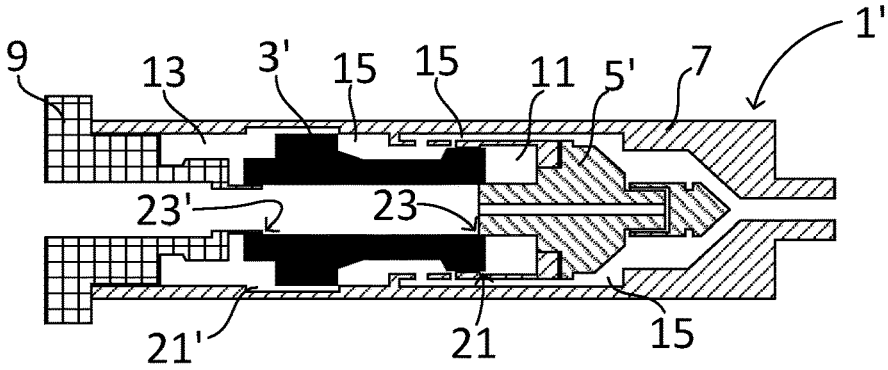

FIG. 1*b* shows the piston 3' a moment later of such movement. The inlet port 21' of the return chamber 13 is just about to be closed herein, and the exhaust port 23 of the drive chamber 11 is here shown to have been closed by means of the movement of the piston 3'. The return chamber 13 is still being pressurized by means of the pneumatic drive system, which continues the movement of the piston 3 towards its first position. The gas within the drive chamber 11 will herein start to be compressed due to the exhaust port 23 being closed. When the inlet port 21' and the exhaust port 23' both are closed, the piston will still accelerate due to an expansion phase of the enclosed gas, and will continue to do so until the exhaust port 23' is opened so as to lower the pressure of the return chamber 13.

Figure 1C:
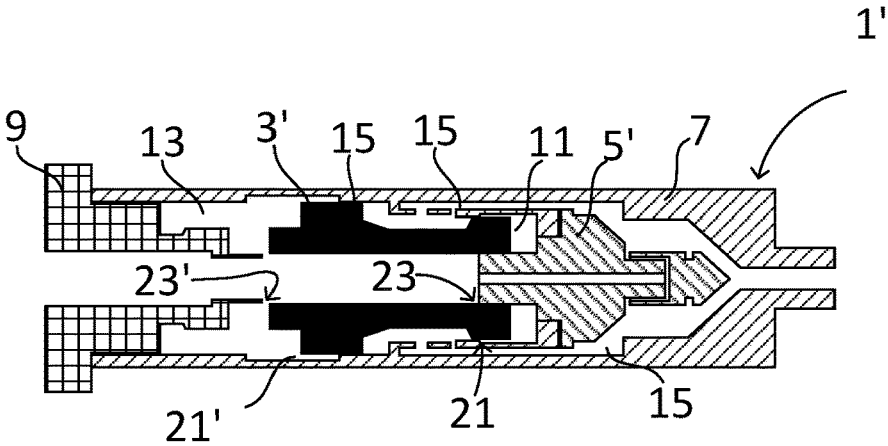

FIG. 1*c* shows the piston 3' a moment later compared to FIG. 1*b*, wherein the movement of the piston 3' herein has closed the inlet port 21' to the return chamber 13, but instead has opened the exhaust port 23' thereof, wherein the pressure of the return chamber 13 here will be lowered. The momentum of the piston 3', combined with geometry thereof, still moves the piston 3' upwards towards its first position.

Figure 1D:
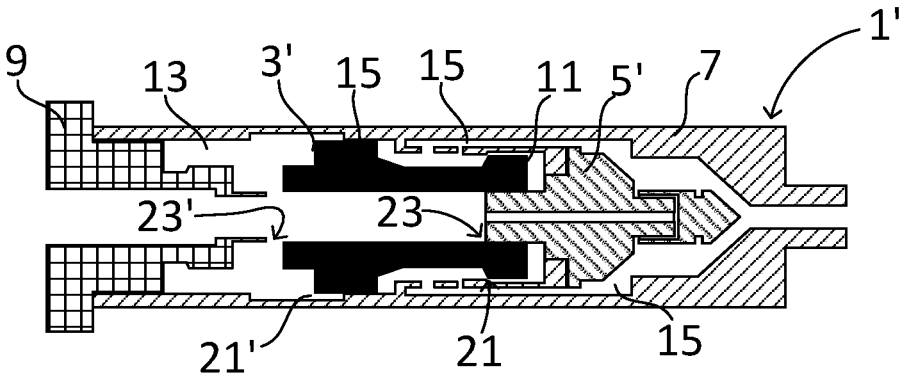

FIG. 1*d* shows the piston 3' a moment later compared to FIG. 1*c*, wherein the movement of the piston 3' herein has opened the inlet port 21 of the drive chamber 11, wherein pressurization of said drive chamber 11 starts to occur. The pressurization of the drive chamber 11 combined with the open and not pressurized return chamber 13 will initiate a change in direction of the movement of the piston 3', wherein a new stroke towards the drill 9 bit will be initiated.

Figure 1E:
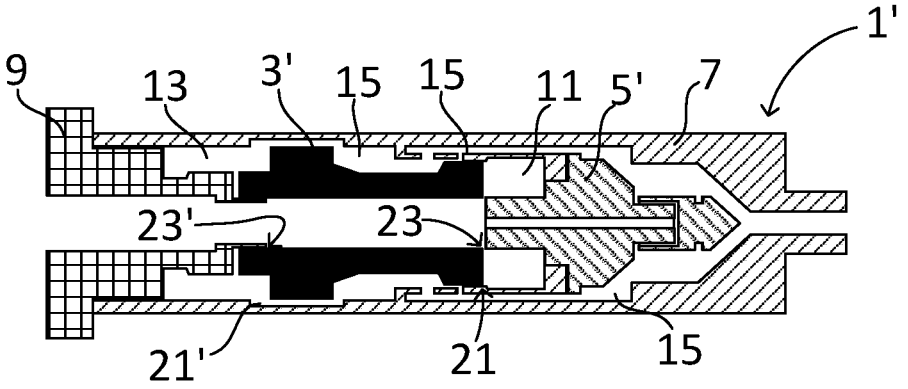

Finally, FIG. 1*e* shows the piston 3' a moment later compared to FIG. 1*d*, wherein the movement of the piston 3' herein has closed the inlet port 21 of the drive chamber 11, opened the exhaust port 23 thereof, and also opened the inlet port 21' of the return chamber 13. All this occurs while the piston 3' moves towards the second position and towards the drill bit 9, so that the cycle may start over after the piston 3' has transferred its kinetic energy to the drill bit 9.

As should be understood by means of the FIGS. 1*a*-1*e*, even if they are not completely extensive, is that is desirable for the piston 3' to hit the drill bit 9 with a high impact motion, and thus transferring a large amount of kinetic force to the drill bit 9. The change from an upwards to a downwards movement however is desired to not occur by means of a crushing impact towards the distributor 5' and/or the housing 7, as such an impact may lead to material degradation and/or mechanical failure of the drill hammer or parts thereof. The drive chamber 11 should thus be able to slow and stop an upwards directed movement of the piston 3', and then in a fast and efficient manner accelerate the piston 3' downwards for a new stroke, in a repeated manner. This is by no means easily achieved while at the same time striving for a compact and efficient design of the drill hammer 1', which design do not rely on adding additional devices such as valves or similar that may alleviate at least parts of the issues, but adding more complexity and potential sources of failure to said drill hammer 1'. From here on out the disclosure will explain how the present invention solves these issues in a very efficient and highly adaptable manner.

Figure 2A:
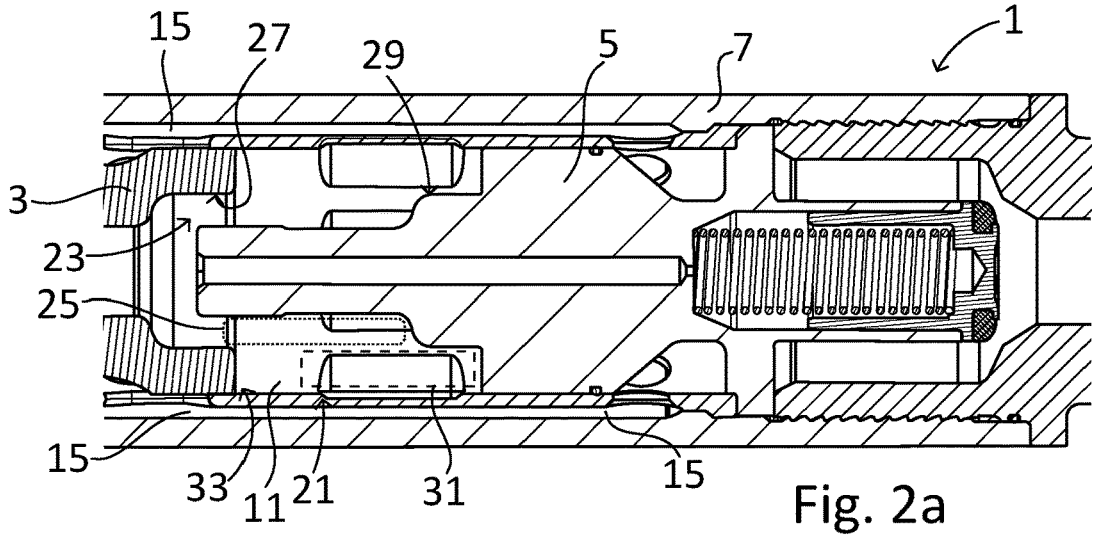
FIGS. 2*a*-2*c* show schematic cross-sectional side views of a drill hammer forming a boost chamber during various stages of its stroke, according to an embodiment.
Figure 2B:
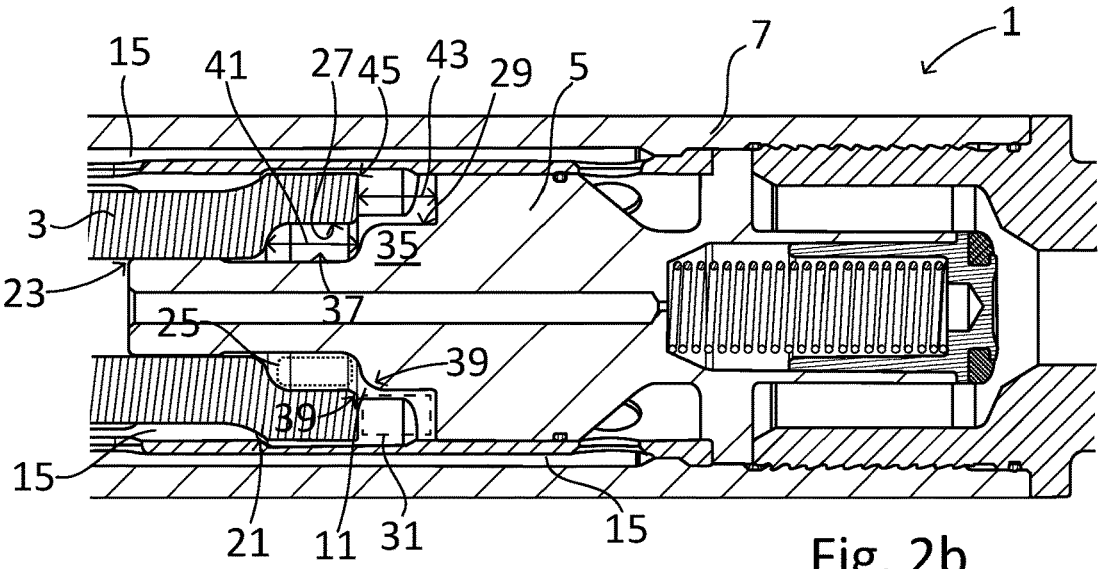
Figure 2C:
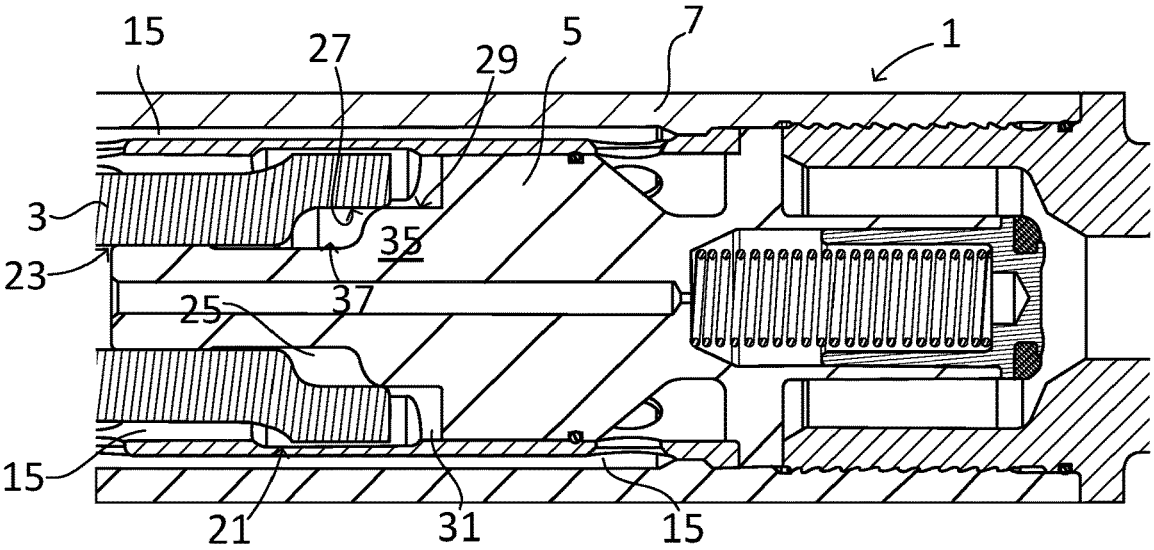

FIGS. 2*a*-2*c* show schematic cross-sectional side views of a drill hammer 1 forming a boost chamber 25 during various stages of its stroke, according to an example. The drill hammer 1 depicted herein is only shown in part, wherein the focus is directed to the drive chamber 11, in which the boost chamber 25 is formed and utilized. As should be realized, the general functionality of the drill hammer 1 should be perceived similar to the depiction according to FIGS. 1*a*-1*e*, wherein it should be assumed that the drill hammer 1 further comprises a return chamber that is cooperating with the drive chamber 11 of the drill hammer, even if said return chamber is not seen in FIGS. 2*a*-2*c*.

FIGS. 2*a*-2*c* thus depicts a pneumatically operated drill hammer 1 that comprises a piston 3 and a distributor 5, axially arranged relative each other in a housing 7. The piston 3 is arranged to be moved axially between a first position and a second position. The drill hammer 1 further comprises a pneumatic drive system, which comprises a drive chamber 11, a return chamber and a plurality of channels 15 for distribution of drive gas in said drive system. The return chamber is arranged at a lower side of the piston (thus not shown in FIGS. 2*a*-2*c*) and the drive chamber 11 is arranged at an upper side 19 of the piston 3, between the piston 3 and the distributor 5. The drive chamber 11 is thus defined by a variable space enclosed by at least the housing 7, the piston 3 and the distributor 5. The drive chamber 11 comprises at least one inlet port 21 and at least one exhaust port 23, arranged at a circumference of the drive chamber 11.

Pressurization of the pneumatic drive system then alternates pressurization of the drive chamber 11 and the return chamber, wherein the piston 3 moves back and forth between the first and second position by means of said alternating pressurization of the drive chamber 11 and return chamber. Furthermore, according to the depictions of FIGS. 2*a*-2*c*, the piston 3 comprises a first inner surface 27, and the distributor 5 comprises a second inner surface 29, wherein said first and second inner surfaces 27, 29 are arranged to align adjacent each other when the piston 3 moves towards the first position. Said alignment then divides the drive chamber 11 into a sub-drive chamber 31 and at least one boost chamber 25, wherein said at least one boost chamber 25 is separated from the inlet and the exhaust ports 21, 23. The term separated is herein to be perceived as being separated from fluid communication with said inlet 21 and exhaust ports 23. It should be mentioned that the drill hammer 1 depicted herein may be a Down-The-Hole, DTH, -hammer. The inventive concept according to the disclosure may however also be utilized for other types of pneumatically controlled drill hammers as well.

FIG. 2*a* show parts of said drill hammer 1, wherein an upper portion 33 of the piston 3 is shown and where said piston 3 is shown in a position between the first and the second position thereof. The distributor 5 is shown to be fixedly arranged relative the housing 7, which is shown only in part. The drive chamber 11 is in the current state, which is correlated to the relative positioning of the piston 3, not divided into the sub-drive chamber 31 and at least one boost chamber 25. The positioning of the piston 3, relative to the housing 7 dictates that the inlet port 21 of the drive chamber 11 is closed in FIG. 2*a*, and simultaneously dictates that the exhaust port 23 is open, which when combined puts the drive chamber 11 in a non-pressurized state. It is to be assumed that at the same time, the non-visible return chamber is in a pressurized state, and/or that the piston has a momentum towards the distributer 5 at this point, wherein the non-pressurized drive chamber 11 decreases in size during such movement. Such movement will continue moving towards the depiction of FIG. 2*b*.

FIG. 2*b* show parts of the same drill hammer 1 as FIG. 2*b*, wherein the upper portion 33 of the piston 3 is shown and where said piston 3 is shown in a position between the first and the second position thereof. In FIG. 2*b*, the movement of the piston 3 has created a new positioning of the piston 3 relative the housing 7 and the distributor 5, wherein in this new relative positioning the inlet port 21 of the drive chamber 11 has just been opened, and the exhaust port 23 is closed. Thus, this relative positioning has initiated a pressure build-up within the drive chamber 11, preparing the piston 3 for its next stroke. Herein it may also be seen that the drive chamber 11 soon will be divided into the sub-drive chamber 31 and the boost chamber 25. According to the depiction presented in FIG. 2*b*, the distributor 5 may comprise a projection 35 and the piston 3 may comprise a recess 37, wherein the first inner surface 27 of the piston 3 is a surface of said recess 37 and the second inner surface 29 is a surface of said projection 35. With continued movement of the piston 3 towards the distributor 5, the recess 37 will slide over the projection 35, similarly to a sleeve element sliding over an axle or similar. The fitting of the recess 37 and the projection 35 is to be perceived as a very accurate fit, wherein fitting of the two will result in an airtight seal when formed. The projection 35 and the recess 37 may be rotationally symmetrical about a longitudinal centre axis of the drill hammer. Such a design may thus provide the same type of relative fitting regardless of the angular positioning of the piston 3 relative the distributor 5. FIG. 2*b* further shows that the initial forming of the boost chamber 25 (which is fully formed in FIG. 2*c*) may be slightly delayed in timing by means of the exact shape of the recess 37 and the projection 35. At least one of the inner surfaces, that is the first inner surface 27 and the second inner surface 29, may comprise a bevelled edge 39, arranged at a side of said inner surface that is aligned with another inner surface to form a boost chamber 25 when the piston 3 moves towards the first position. In FIG. 2*b*, both the edge 39 of the recess 37 and the edge 39 of the projection 35 comprises rounded edges 39, which provides a smoother and less abrupt initial forming and closing/sealing of the boost chamber 25. This will thus provide a gradually decreasing fluid communication between the boost chamber 25 (to be) and the sub-drive chamber 31 when divided from the drive chamber 11. This may be modified in various ways to adjust and affect the functionality of the boost chamber 11. This will further be expanded upon with reference to FIGS. 3*a*-3*f*.

The drill hammer 1 will after a certain amount of time there between, move from the positioning of the piston as shown in FIG. 2*b* to a new positioning as depicted in FIG. 2*c*. In FIG. 2*c*, the boost chamber 25 is now fully formed as the first inner surface 27 of the recess 37 of the piston 3 and the second inner surface 29 of the projection 35 of the distributor 5 now have aligned and completely divided the drive chamber 11 into the boost chamber 25 and the sub-drive chamber 31. The sub-drive chamber 31 is still in fluid communication with the open inlet port 21, wherein further pressurization of said sub-drive chamber 31 still may occur to provide a downwards directed force to the piston 3. The boost chamber 25 however is, as is seen in FIG. 2*c*, separated from the inlet and the exhaust ports 21, 23. The inlet port 21 of the drive chamber 11 is simply not in fluid communication with the boost chamber 11, and the exhaust port 23 is not open, wherein fluid communication there between is not possible. This provides a closed boost chamber 25, having a certain amount of drive gas therein. Any further movement of the piston 3 towards the distributor 5 will thus result in a pressure built-up within the boost chamber 11, which pressure build-up directly provides a force to the piston 3, which force wants to push the piston 3 and the distributor 5 apart, which corresponds to pushing the piston 3 away from the distributor 5, as the distributor 5 is fixedly attached in the housing 7. Such a force will thus act as a brake for the piston 3 moving towards the distributor 5, which hence will slow down such movement. The more the boost chamber 25 is compressed, the larger the slowing force will be, making the piston 3 automatically slow down any further compression, until the piston 3 fully reaches its first position. At the first position, the pressure build-up within the sub-drive chamber 31, combined with the force within the boost chamber 25 will start to accelerate the piston 3 back towards the drill bit so as to performs its next stroke thereto. This allows for a very simple yet highly effective manner of having the piston 3 change direction without any mechanical contact between the piston 3 and the distributor 5, all while not relying on additional complex devices or similar. It may also be seen in FIG. 2*c* that the sub-drive chamber 31 and the boost chamber 25 when formed may comprise inner axially lengths 41, 43 separate in size at any given moment. For the embodiment shown in FIGS. 2*a*-2*c*, the inner axial length 41 of the boost chamber 25 is longer than the inner axial length 43 of the sub-drive chamber 31. Such a design ensures that the boost chamber 25 will never be fully depleted, and if the pneumatic drive system for some reason would lose its pressure entirely, an uppermost surface 45 of the piston 3 would be more inclined to abut the distributor 5 than the parts of the piston forming the boost chamber 25. This is however not likely to occur at all as the sub-drive chamber 31 also would be closed off from fluid communication with the inlet port 21 if the piston 3 would be moved further towards the distributor 5. The shape and size of the boost chamber 25, the sub-drive chamber 31 and the ratios there between may however be modified in various manners to achieve and provide different characteristics of the pressurization of the various chambers 11, 25, 31, and thus be utilized to affect the stroke and the performance of the drill hammer 1. This will be further expanded upon with reference to FIGS. 3*a*-3*f*.

FIGS. 3*a*-3*f* show schematic cross-sectional side views of parts of a piston 3 and parts of a distributor 5 according to various embodiments. Herein it will be explained how the characteristics of the piston 3 movement may be modified or adjusted by means of making geometrical and/or other modifications to the piston 3 and/or the distributor 5. For example, when drilling in rock-type material of various hardness, the stroke of the piston 3 may have different stroke characteristics being most suitable to perform the best for said different hardness of the material. It is however not very cost or time efficient to swap out the entire drill hammer 1 when swapping between different materials to drill in. The drill hammer 1 according to the disclosure herein may thus alleviate such issues, as various shapes and sizes of boost chambers 25 may modify the characteristics and performance of the stroke. It may thus be possible to swap between various pistons 3 having varying types of boost chambers 25, but using the same distributor 5 and housing, and completely change the performance of the drill in its entirety, as one example. This provides an improved modularity of such drills and systems, being more cost effective and less time consuming for operators using such a solution.

Figure 3A:
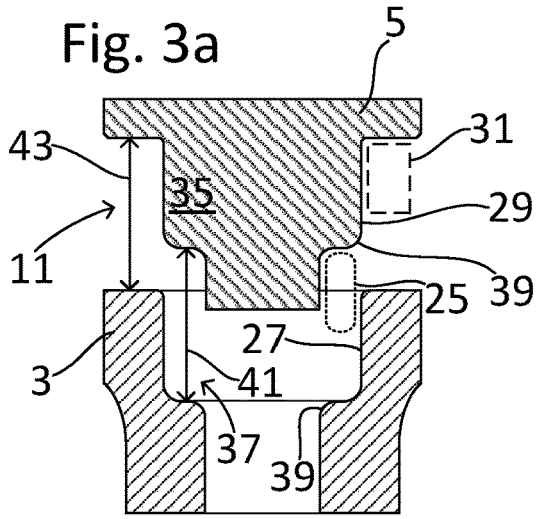
FIGS. 3*a*-3*f* show schematic cross-sectional side views of parts of a piston and parts of a distributor according to various embodiments.

FIG. 3*a* shows an example of the top of the piston 3 and parts of the distributor 5, both being part of a drill hammer according to the disclosure. In FIG. 3*a* the drive chamber 11 is not yet divided into its respective sub-chambers 25, 31, but it should be obvious with guidance of the disclosure in its entirety how that would occur if the two parts 3, 5 would be moved towards each other. When the drive chamber 11 is divided into the sub-drive chamber 31 and the boost chamber 25 with this example of the piston 3 and the distributor 5, the sub-drive chamber 31 and the boost chamber 25 when formed may comprise inner axially lengths 41, 43 equal in size at any given moment. The edges 39 of the first and second inner surfaces 27, 29 further comprises bevelled edges 39, or more precisely rounded edges 39. This design and configuration will provide a specific interaction of the recess 37 and the projection 35 when the boost chamber 25 is formed, wherein the stroke of the piston 3 will corresponds to said specific interaction, due to the boost chamber 25 being compressed in a corresponding specific manner, and having a specific behaviour directly relating thereto.

Figure 3B:
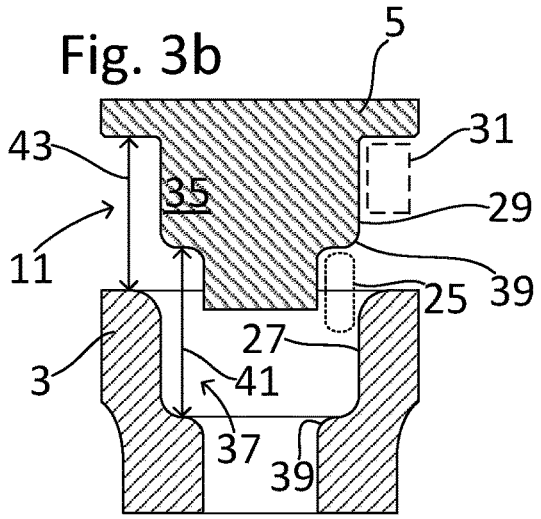

FIG. 3*b* depicts an alternative design of the piston 3, but the distributor 5 being the same shape and size compared to FIG. 3*a*. Herein the recess 37 of the piston 3 is larger comparatively, which in turn results in that the inner axial length 41 of the boost chamber 25 is longer than the inner axial length 43 of the sub-drive chamber 31. When comparing the behaviour of the embodiments according to FIGS. 3*a* and 3*b*, the boost chamber 25 of FIG. 3*a* will thus be formed and activated earlier than the boost chamber 25 of FIG. 3*b*, which in turn provides a shorter stroke for the piston 3 when using the design of FIG. 3*a*. The edge 39 of the first inner surface 27 of the piston 3 is herein shown to be rounded with a larger radius compared to the embodiment of FIG. 3*a* as well. Such an alteration may be utilized for fine-tuning of the performance of the boost chamber 25, as described earlier in the disclosure.

FIGS. 3*a* and 3*b* exemplifies how the drill hammer may be modified in a simple manner. The embodiment of FIG. 3*a* exhibits a shorter stroke and a higher frequency, which is highly suitable for drilling in comparatively softer rock-type material, while the embodiment of FIG. 3*b* exhibits a longer stroke and a lower frequency, which is suitable for drilling in comparatively harder rock-type material.

Figure 3C:
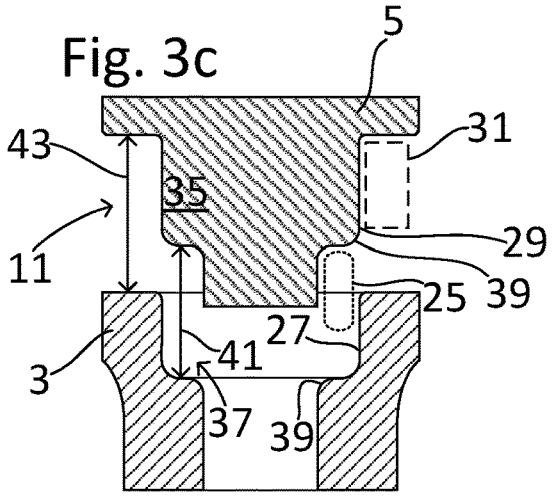

FIG. 3*c* depicts another alternative embodiment of the piston 3 and the distributor 5, wherein the inner axial length 41 of the boost chamber 25 herein is shorter than the inner axial length 43 of the sub-drive chamber 31 when the drive chamber 11 is divided into the sub-drive chamber 31 and the boost chamber 25 using this embodiment. This alters the volume of the sub-drive chamber 31 when the boost chamber 25 is compressed, which may be utilized for providing further modifications to the performance of the drill hammer.

Figure 3D:
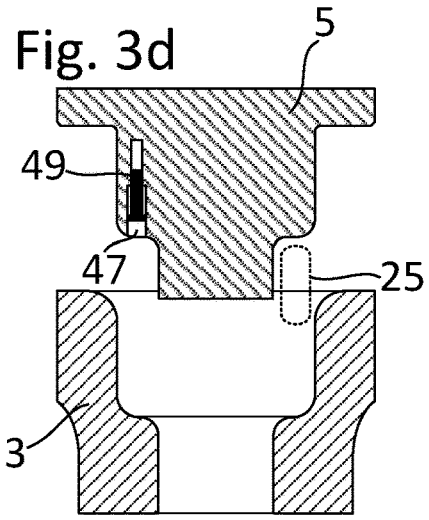

FIG. 3*d* exemplifies how the inventive concept may be even further modified and fine-tuned, to correspondingly modify the performance of the drill hammer when used. According to the embodiment depicted in FIG. 3*d*, a sidewall of the boost chamber 25 may comprise a hole 47, in which an adjustable element 49 may be arranged to be selectively movable to adjust a volume of said hole 47. Positioning of the adjustable element 49 in the hole may thus be used to regulate an internal volume of the boost chamber 25, which in turn affect how much said boost chamber 25 may be compressed before the movement of the piston 3 is fully stopped in its upwards direction (upwards as viewed in the current figures). By means of providing this feature to the drill hammer, an even wider range of characteristics may be obtained using fewer combinations of differently shaped pistons 3 and distributors 5, as the specific volume of each boost chamber 25 being formed using such different combinations may always be fine-tuned using the adjustable element 49 to regulate the internal volume of said boost chamber 25. The adjustable element 49 may for example be a screw, threaded into the hole 47 in the sidewall.

Figure 3E:
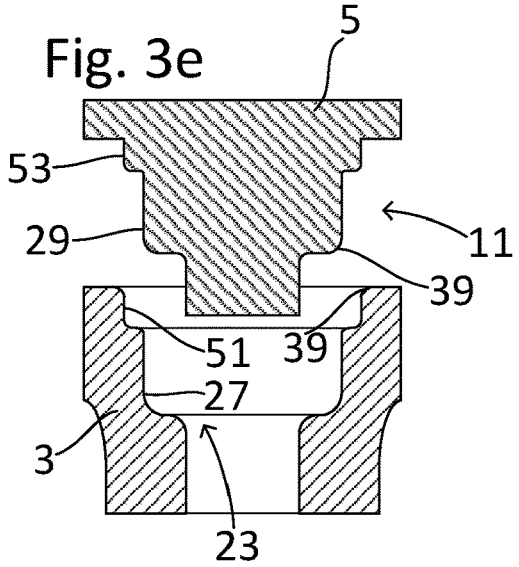
Figure 3F:
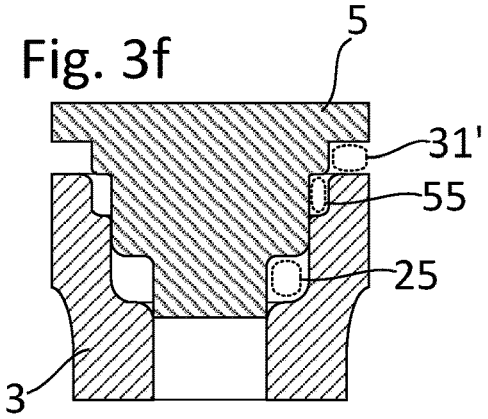

FIGS. 3*e* and 3*f* shows an even further alternative embodiment of the piston 3 and the distributor 5 of a drill hammer, being in different relative positioning to each other. The piston 3 may, as depicted in FIGS. 3*e* and 4*f*, comprise a third inner surface 51, and the distributor 5 may comprise a fourth inner surface 53, wherein said third and fourth inner surfaces 51, 53 may be arranged to align adjacent each other when the piston 3 moves towards its first position (similar to the first and second inner surfaces). Said alignment may then divide the drive chamber further 11 and form a second boost chamber 55, said second boost chamber 55 being separated from the first boost chamber 25 and the inlet and exhaust ports. As should be obvious, the drill hammer may comprise an even larger number of boost chambers 25 as well, without deviating from the inventive concept of the disclosure. FIG. 3*e* shows the piston 3 and the distributor 5 positioned at a distance away from each other, wherein the drive chamber 11 herein is not divided, and not pressurized as the exhaust port 23 is fully opened. FIG. 3*f* shows the same embodiment as FIG. 3*e*, but in this depiction, the piston 3 has been moved closer to the distributor 5, wherein the exhaust port 23 is closed, and the (first) boost chamber 25 is formed and compression thereof has been initiated. The sub-drive chamber 31 is herein shown to still be in fluid communication with an internal volume that is to be formed into the second boost chamber 55 if the upwards movement of the piston 3 is continued. Such a continued upwards movement will thus further divide the sub-drive chamber 31 into a smaller sub-drive chamber 31' and the second boost chamber 55. This will thus provide a first compression of the first boost chamber 25, followed by a second compression of the second boost chamber 55, wherein the movement of the piston 3 is further modified, dependent on the shape and sizes of the two boost chambers 25, 55 and the shape of the first, second, third and fourth inner surfaces 27, 29 51, 53, and their respective edges 39 thereof. As should be obvious, said edges 39 may exhibit different characteristics similarly to the various shapes of the bevelled edges 39 as explained prior in the disclosure.

Figure 4:
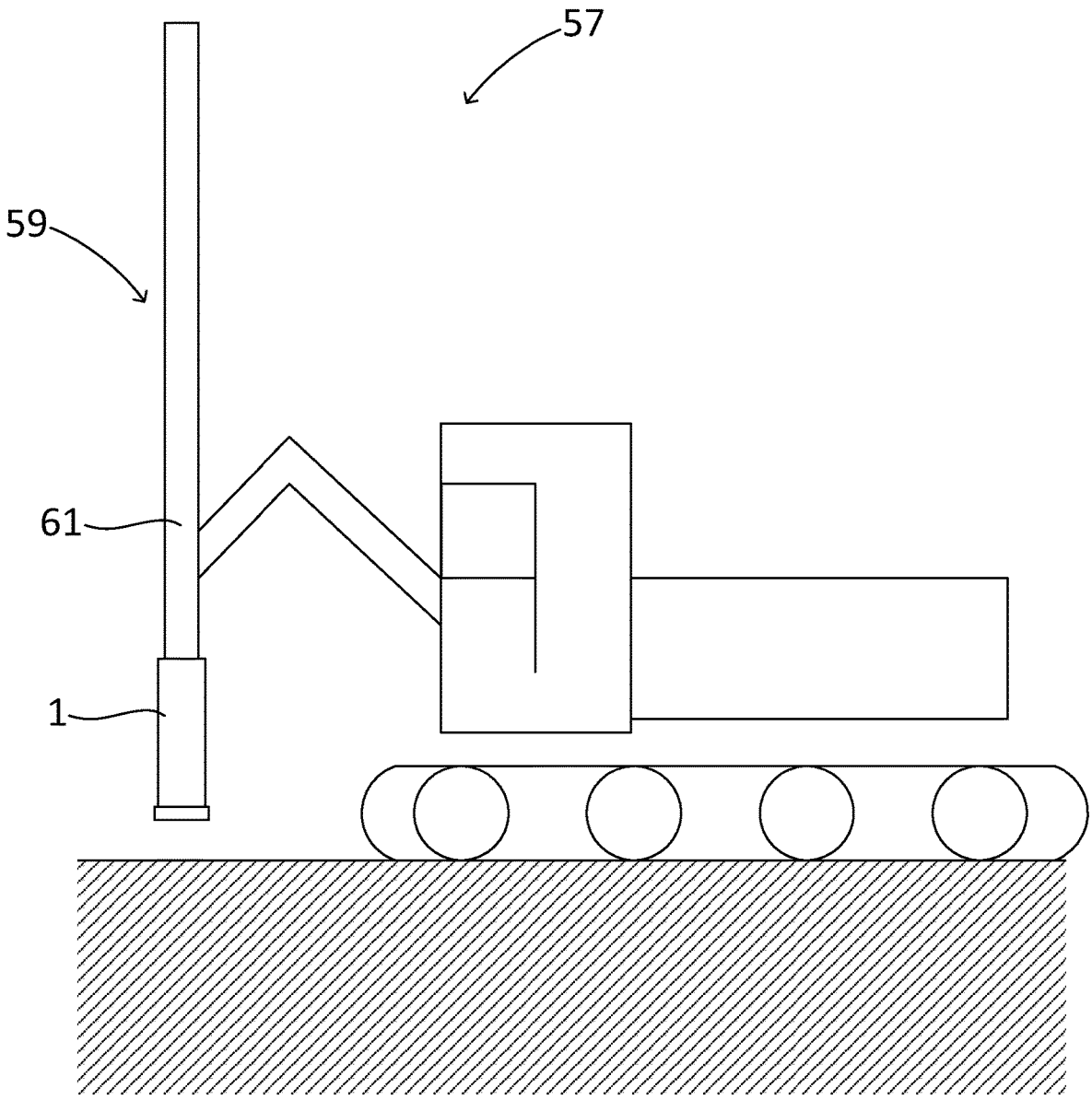
FIG. 4 shows a schematic side view of a Down-The-Hole, DTH,-drilling rig, according to an embodiment.

FIG. 4 shows a schematic side view of a Down-The-Hole, DTH,-drilling rig 57, according to an example. The Down-The-Hole, DTH,-drilling rig 57 comprises a drill line 59, comprising at least one drill pipe 61, a source of drive gas (not shown) and at least one pump (not shown) for control of said drive gas. The drill line 59 further comprises a Down-The-Hole, DTH,-drill hammer 1 according to the disclosure. As should be obvious, the drill hammer 1 of the drilling rig 57 may exhibit a large variety of features and combinations thereof, corresponding to the various features as explained in detail throughout the disclosure describing solely the drill hammer 1 herein. A Down-The-Hole, DTH,-drilling rig 57 provided with a drill hammer 1, according to the disclosure, will provide an improved feeding force and rotational speed compared to prior art solutions. It should also be mentioned that the drill hammer 1 according to the first aspect of the disclosure may be used for other types of drilling rigs as well. The inventive concept of dividing the drive chamber of a pneumatically operated drill hammer into a sub-drive chamber and a boost chamber is by no means restricted to a Down-The-Hole, DTH,-drilling rig, but on the contrary can be utilized for any type of drilling rig that comprises a pneumatically operated drill hammer.

The foregoing description of the embodiments has been furnished for illustrative and descriptive purposes. It is not intended to be exhaustive, or to limit the embodiments to the variations described. Many modifications and variations will obviously be apparent to one skilled in the art. The embodiments have been chosen and described in order to best explicate principles and practical applications, and to thereby enable one skilled in the arts to understand the invention in terms of its various embodiments and with the various modifications that are applicable to its intended use. The components and features specified above may, within the framework of the disclosure, be combined between different embodiments specified.

The invention claimed is:

1. A pneumatically operated drill hammer comprising a piston and a distributor that are axially arranged relative to each other in a housing, the piston being arranged to be moved axially between a first position and a second position, wherein the drill hammer further comprises a pneumatic drive system comprising a drive chamber, a return chamber, and a plurality of channels for distribution of drive gas in the drive system, the return chamber being arranged at a lower side of the piston and the drive chamber being arranged at an upper side of the piston, wherein the drive chamber is positioned between the piston and the distributor, wherein the drive chamber is defined by a variable space enclosed by at least the housing, the piston, and the distributor, the drive chamber comprising at least one inlet port and at least one exhaust port arranged at a circumference of the drive chamber, wherein pressurization of the pneumatic drive system alternates pressurization of the drive chamber and the return chamber, wherein the piston moves back and forth between the first and second position by means of the alternating pressurization of the drive chamber and return chamber, wherein the piston comprises a first inner surface, and the distributor comprises a second inner surface, the first inner surface and the second inner surface are being arranged to align adjacent to each other in an event the piston moves towards the first position, wherein the alignment divides the drive chamber into a sub-drive chamber and at least one boost chamber, the at least one boost chamber being separated from the inlet port and the exhaust port, and wherein:

at least one of the first inner surface and the second inner surface comprises a bevelled edge, arranged at a side of one of the at least first inner surface and the second inner surface, and the side is aligned with another of the at least first inner surface and the second inner surface to form a boost chamber in the event the piston moves towards the first position.

2. The drill hammer according to claim 1, wherein in the event of formation of the sub-drive chamber and the boost chamber, the sub-drive chamber and the boost chamber comprise inner axially lengths separate in size at any given moment.

3. The drill hammer according to claim 2, wherein the inner axial length of the boost chamber is longer than the inner axial length of the sub-drive chamber.

4. The drill hammer according to claim 2, wherein the inner axial length of the boost chamber is shorter than the inner axial length of the sub-drive chamber.

5. The drill hammer according to claim 1, wherein in the event of formation of the sub-drive chamber and the boost chamber, the sub-drive chamber and the boost chamber comprise inner axially lengths equal in size at any given moment.

6. The drill hammer according to claim 1, wherein the distributor comprises a projection and the piston comprises a recess, and wherein the first inner surface of the piston is a surface of the recess and the second inner surface is a surface of the projection.

7. The drill hammer according to claim 6, wherein the projection and the recess are rotationally symmetrical about a longitudinal centre axis of the drill hammer.

8. The drill hammer according to claim 1, wherein a sidewall of the boost chamber comprises a hole in which an adjustable element is arranged to be selectively movable to adjust a volume of the hole, and wherein positioning of the adjustable element in the hole regulates an internal volume of the boost chamber.

9. The drill hammer according to claim 1, wherein the piston comprises a third inner surface and the distributor comprises a fourth inner surface, the third and the fourth inner surfaces are arranged to align adjacent to each other in the event the piston moves towards the first position, wherein the alignment divides the drive chamber further and forms a second boost chamber, the second boost chamber being separated from the first boost chamber, the inlet port, and the exhaust port.

10. The drill hammer according to claim 1, wherein the drill hammer is a Down-The-Hole (DTH), hammer.

11. A drilling rig comprising a drill line, at least one drill pipe, a source of drive gas, and at least one pump to control the drive gas, wherein the drill line comprises a drill hammer, the drill hammer comprises a piston and a distributor that are axially arranged relative to each other in a housing, the piston being arranged to be moved axially between a first position and a second position, wherein the drill hammer further comprises a pneumatic drive system comprising a drive chamber, a return chamber, and a plurality of channels for distribution of drive gas in the drive system, the return chamber being arranged at a lower side of the piston and the drive chamber being arranged at an upper side of the piston, wherein the drive chamber is positioned between the piston and the distributor, wherein the drive chamber is defined by a variable space enclosed by at least the housing, the piston, and the distributor, the drive chamber comprising at least one inlet port and at least one exhaust port arranged at a circumference of the drive chamber, wherein pressurization of the pneumatic drive system alternates pressurization of the drive chamber and the return chamber, wherein the piston moves back and forth between the first and second position by means of the alternating pressurization of the drive chamber and return chamber, wherein the piston comprises a first inner surface, and the distributor comprises a second inner surface, the first inner surface and the second inner surface are arranged to align adjacent to each other in an event the piston moves towards the first position, wherein the alignment divides the drive chamber into a sub-drive chamber and at least one boost chamber, the at least one boost chamber being separated from the inlet port and the exhaust port, and wherein:

at least one of the first inner surface and the second inner surface comprises a bevelled edge, arranged at a side of one of the at least first inner surface and the second inner surface, and the side is aligned with another of the at least first inner surface and the second inner surface to form a boost chamber in the event the piston moves towards the first position.

12. A pneumatically operated drill hammer comprising a piston and a distributor that are axially arranged relative to each other in a housing, the piston being arranged to be moved axially between a first position and a second position, wherein the drill hammer further comprises a pneumatic drive system comprising a drive chamber, a return chamber, and a plurality of channels for distribution of drive gas in the drive system, the return chamber being arranged at a lower side of the piston and the drive chamber being arranged at an upper side of the piston, wherein the drive chamber is positioned between the piston and the distributor, wherein the drive chamber is defined by a variable space enclosed by at least the housing, the piston, and the distributor, the drive chamber comprising at least one inlet port and at least one exhaust port arranged at a circumference of the drive chamber, wherein pressurization of the pneumatic drive system alternates pressurization of the drive chamber and the return chamber, wherein the piston moves back and forth between the first and second position by means of the alternating pressurization of the drive chamber and return chamber, wherein the piston comprises a first inner surface, and the distributor comprises a second inner surface, the first inner surface and the second inner surface are arranged to align adjacent to each other in an event the piston moves towards the first position, wherein the alignment divides the drive chamber into a sub-drive chamber and at least one boost chamber, the at least one boost chamber being separated from the inlet port and the exhaust port, wherein a sidewall of the boost chamber comprises a hole in which an adjustable element is arranged to be selectively movable to adjust a volume of the hole, and wherein positioning of the adjustable element in the hole regulates an internal volume of the boost chamber, and wherein:

at least one of the first inner surface and the second inner surface comprises a bevelled edge, arranged at a side of one of the at least first inner surface and the second inner surface, and the side is aligned with another of the at least first inner surface and the second inner surface to form a boost chamber in the event the piston moves towards the first position.

* * * * *